US007040917B2

(12) United States Patent
Yagi et al.

(10) Patent No.: US 7,040,917 B2
(45) Date of Patent: May 9, 2006

(54) ELECTRICAL CONNECTOR ASSEMBLY

(75) Inventors: Masanori Yagi, Kanagawa (JP); Junichi Miyazawa, Yokohama (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/981,069

(22) Filed: Nov. 4, 2004

(65) Prior Publication Data

US 2005/0106931 A1 May 19, 2005

(30) Foreign Application Priority Data

Nov. 4, 2003 (JP) ..... 2003-374398

(51) Int. Cl.
*H01R 12/24* (2006.01)

(52) U.S. Cl. ..... 439/495; 439/499; 439/579; 439/610

(58) Field of Classification Search ..... 439/495, 439/497, 499, 492, 610, 607, 579
See application file for complete search history.

(56) References Cited

U.S. PATENT DOCUMENTS

| | | | |
|---|---|---|---|
| 4,993,968 | A | 2/1991 | Guletsky et al. |
| 5,281,762 | A | 1/1994 | Long et al. |
| 5,964,620 | A | 10/1999 | Takahashi et al. |
| 5,980,308 | A | 11/1999 | Hu et al. |
| 6,039,611 | A | 3/2000 | Yang |
| 6,083,048 | A | 7/2000 | Yamaguchi |
| 6,123,582 | A | 9/2000 | Ko et al. |

(Continued)

FOREIGN PATENT DOCUMENTS

| | | |
|---|---|---|
| EP | 1 320 149 A2 | 6/2003 |

(Continued)

OTHER PUBLICATIONS

International Search Report.

*Primary Examiner*—Gary F. Paumen
*Assistant Examiner*—X. Chung Trans
(74) *Attorney, Agent, or Firm*—Stephen Z. Weiss

(57) ABSTRACT

An electrical connector assembly includes a receptacle connector (24) having a first non-conductive housing (51) for mounting on a printed circuit board (28) and including a mating receptacle (54). A plurality of board terminals (52) are mounted on the first housing and have tail portions (62) for connection to appropriate circuit traces on the circuit board and contact portions (58,58*a*) extending into the mating receptacle. A plug connector (22) has a second non-conductive housing (30) including a mating plug portion (30*b*) for insertion into the mating receptacle of the receptacle connector. A plurality of signal terminals (32) are mounted on the second housing and have contact portions (32*b*) on the mating plug portion thereof for engaging the contact portions of the board terminals in the mating receptacle when the connectors are mated. The signal terminals include terminating portions (32*a*) for termination to a plurality of discrete signal conductors (26*a*). A single metal shell (42) is mounted on the second housing of the plug connector and projects therefrom over the first housing of the receptacle connector to shield the mating interface between the board terminals and the signal terminals when the connectors are mated.

6 Claims, 7 Drawing Sheets

U.S. PATENT DOCUMENTS 6,139,372 A 10/2000 Yang
6,206,722 B1 3/2001 Ko et al.
6,250,953 B1 6/2001 Niitsu
6,250,959 B1 6/2001 Yamaguchi et al.
6,273,753 B1 8/2001 Ko
6,305,978 B1 10/2001 Ko et al.
6,305,979 B1 10/2001 Ko
6,338,652 B1 1/2002 Ko
6,364,702 B1 * 4/2002 Mochizuki et al. ..... 439/579
6,454,606 B1 9/2002 Igarashi
6,475,024 B1 11/2002 Narui
6,544,050 B1 4/2003 Ko
6,606,787 B1 8/2003 Okumura et al.
6,705,893 B1 * 3/2004 Ko ..... 439/607

FOREIGN PATENT DOCUMENTS

JP 2002-8765 1/2002
JP 2002-50441 2/2002

* cited by examiner

ELECTRICAL CONNECTOR ASSEMBLY

FIELD OF THE INVENTION

This invention generally relates to the art of electrical connectors and, particularly, to a shielded electrical connector assembly.

BACKGROUND OF THE INVENTION

Various electrical connector assemblies have been provided with one connector mounted on and terminated to a printed circuit board and a second, mating connector terminated to a plurality of discrete electrical conductors. For instance, a female or receptacle connector may be mounted on the circuit board, and a male or plug connector may be terminated to the electrical conductors.

Some systems, including electrical connector assemblies as described above, are shielded systems to provide EMI and RFI protection for the entire connecting interface. For instance, the one connector mounted to the circuit board includes an enclosing metal shell or shield which is connected to a ground trace on the circuit board. The electrical conductors are cores of shielded electrical cables which include shielding braids, and the second or mating connector includes a second metal shell mounted in engagement with the shielding braids of the cables. Therefore, when the connectors are mated, the two metal shells of the two connectors are interengaged to ground the shielding braids of the electrical cables to the ground trace on the circuit board, while the two metal shells provide EMI and RFI protection for the entire mating interface of the connectors.

A problem with such connector assemblies as described above is that the two metal shells of the two mating connectors increase the number of parts of the assembly, resulting in increased manufacturing and assembly costs. Another problem is that the metal shell of the connector which is terminated to the electrical cables has a tendency to damage the cables, particularly the shielding braids of the cables, during assembly, shipping, handling and repeated usage. The present invention is directed to solving these problems.

SUMMARY OF THE INVENTION

An object, therefore, of the invention is to provide a new and improved shielded electrical connector assembly of the character described.

In the exemplary embodiment of the invention, the connector assembly includes a receptacle connector having a first dielectric housing for mounting on a printed circuit board and including a mating receptacle. A plurality of board terminals are mounted on the first housing and have tail portions for connection to appropriate circuit traces on the circuit board and contact portions extending into the mating receptacle. A plug connector has a second dielectric housing including a mating plug portion for insertion into the mating receptacle of the receptacle connector. A plurality of signal terminals are mounted on the second housing and have contact portions on the mating plug portion thereof for engaging the contact portions in the mating receptacle when the connectors are mated. The signal terminals include terminating portions for termination to a plurality of discrete signal conductors. A single metal shell is mounted on the second housing of the plug connector and projects therefrom over the first housing of the receptacle connector to shield the mating interface between the board terminals and the signal terminals when the connectors are mated.

According to one aspect of the invention, the receptacle connector includes at least one ground terminal having a tail portion for connection to an appropriate ground trace on the circuit board. A contact portion of the ground terminal engages the metal shell when the connectors are mated to ground the metal shell on the plug connector to the circuit board on which the receptacle connector is mounted.

According to another aspect of the invention, the signal conductors comprise conductive cores of a plurality of shielded electrical cables having ground components, such as shielding braids or sheaths, coupled to the metal shell. In the exemplary embodiment, at least one conductive ground bar extends across and in engagement with the shielding sheaths. The metal shell has an engagement portion in engagement with the ground bar. The engagement portion comprises an inwardly folded flange along a rear end of the shell. The shell includes a top wall and opposite side walls for covering respective top and side walls of the dielectric housing of the receptacle connector, and the flange is folded inwardly under a rear edge of the top wall of the shell and spaced therefrom.

Other objects, features and advantages of the invention will be apparent from the following detailed description taken in connection with the accompanying drawings.

BRIEF DESCRIPTION BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
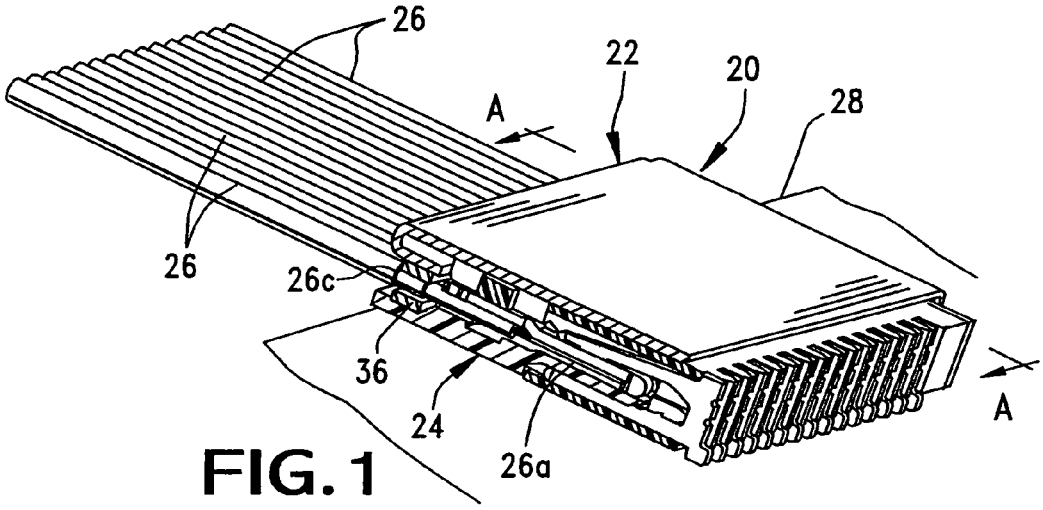
FIG. 1 is a perspective view, partially in section, of an electrical connector assembly according to the invention.

Referring to the drawings in greater detail, the invention is embodied in a shielded electrical connector assembly, generally designated 20, which includes a plug connector, generally designated 22, mateable with a receptacle connector, generally designated 24. The plug connector is terminated to the discrete conductors of a plurality of electrical cables 26, and the receptacle connector is mounted on top of a printed circuit board 28.

Figure 2:
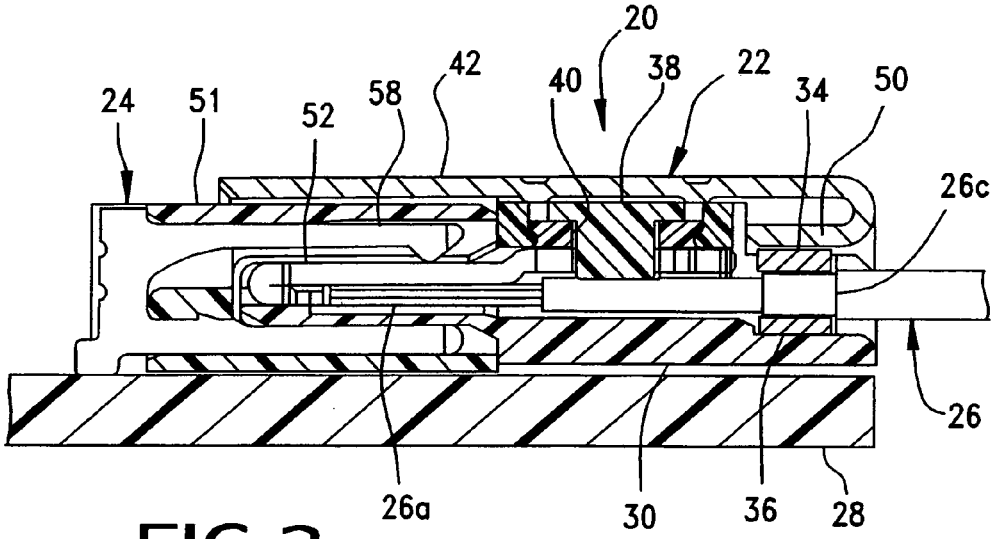
FIG. 2 is a vertical section taken generally along line A—A in FIG. 1.
Figure 4:
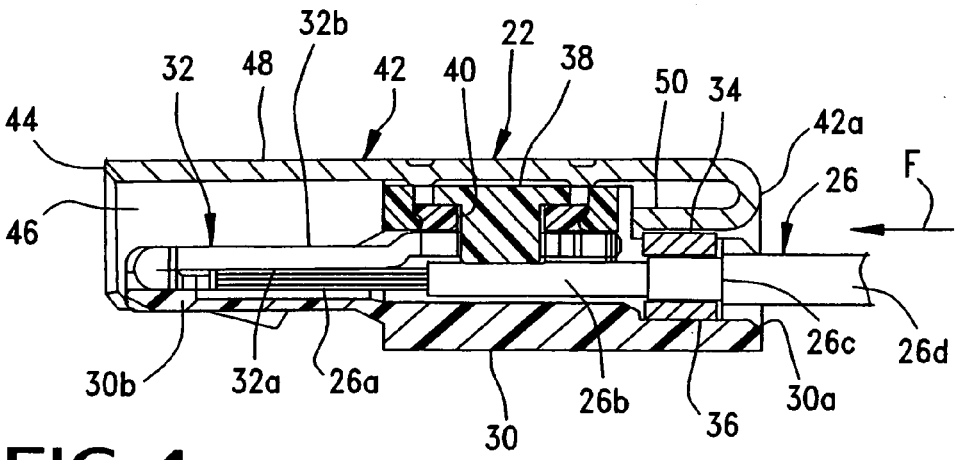
FIG. 4 is an enlarged vertical section taken generally along line B—B in FIG. 3.
Figure 3:
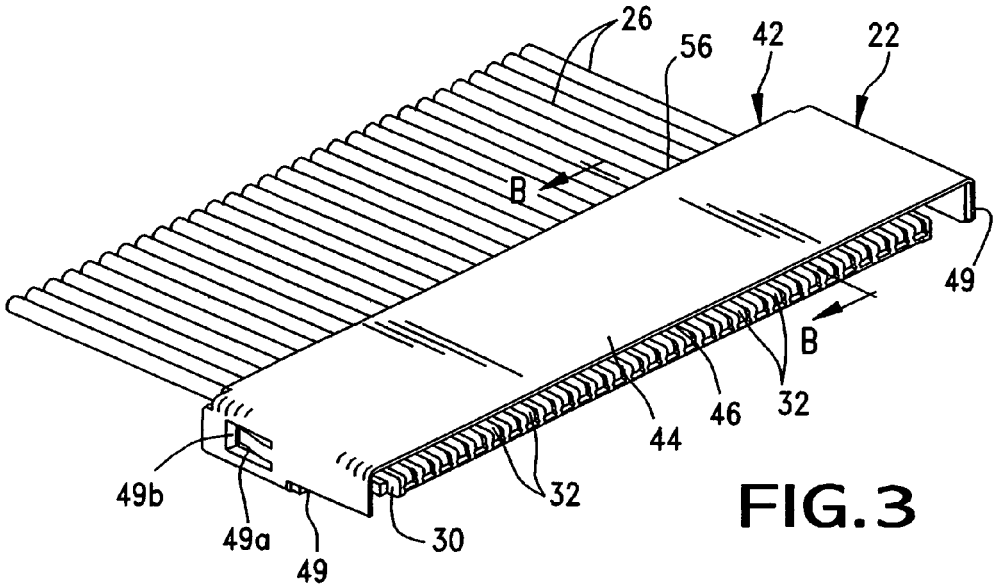
FIG. 3 is a perspective view of the plug connector of the invention.

Referring to FIGS. 3 and 4 in conjunction with FIGS. 1 and 2, pug connector 22 of connector assembly 20 includes an insulative or dielectric housing 30 which mounts a plurality of signal terminals 32. Before proceeding further, an explanation of each electrical cable 26 is in order. Each cable includes a center conductor or core 26*a* surrounded by a dielectric 26*b*. A grounding sheath in the form of a metal braid or mesh 26*c* surrounds the dielectric, and an outer cover 26*d* encases the cable. Housing 30 includes a rear opening 30*a* into which the cables are inserted in the direction of arrow "F" (FIG. 4) and a forwardly projecting plug portion 30*b*. Bottom surfaces 32*a* of signal terminals 32 are electrically connected, as by soldering, to the tops of conductors 26*a* of the cables. Top surfaces 32*b* of the signal terminals engage the terminals of receptacle connector 24 as will be described in greater detail hereinafter.

Still referring to FIG. 4 in conjunction with FIGS. 1 and 2, plug connector 22 further includes top and bottom ground bars 34 and 36, respectively, which are connected, as by soldering, to mesh shields 26*c* of all of the electrical cables. It can be seen in FIGS. 1 and 3 that the cables are in a linear or planar array. Ground bars 34 and 36 are generally flat, narrow and elongated members. A cable retainer 38 is press-fit into the housing into engagement with the dielectrics 26*b* of the cables. The cable retainer is press-fit into a retainer hole 40 in the dielectric housing.

Plug connector 22 further includes a shield in the form of a metal shell, generally designated 42. The shell includes a front end 44 which extends slightly forwardly of plug portion 30*b* of the housing and slightly forwardly of the forward distal ends of signal terminals 32, as can be seen clearly in FIG. 4. The front end of the metal shell forms a shroud and defines an opening 46 above signal terminals 32. The metal shell is generally U-shaped and includes a top wall 48 and a pair of opposite, depending side walls 49. The metal shell may be stamped and formed of sheet metal material, and a pair of latches 49*a* (FIG. 3) are stamped and formed out of 49*b* in side walls 49 to lock the shell to housing 30.

As best seen in FIGS. 2 and 4, a rear end 42*a* of metal shell 42 has a unique configuration and includes an inwardly folded flange 50 which extends along substantially the entire width of the shell. The flange is folded or bent under top wall 48 of the shell at the rear edge thereof and is spaced beneath the top wall as can be clearly seen in FIGS. 2 and 4. Flange 50 is maintained in engagement with top ground bar 34 which, in turn, is in engagement with the mesh shields 26 of electrical cables 26. Therefore, the metal shell is commoned through the ground bar to the grounding shields of the cables.

Figure 5:
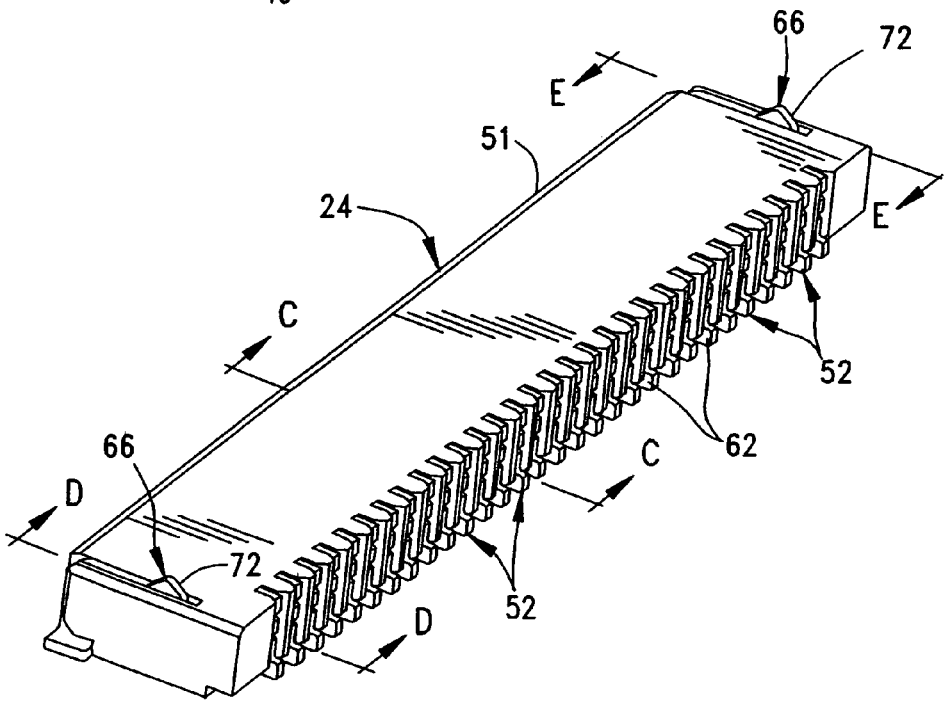
FIG. 5 is a perspective view of the receptacle connector of the invention.
Figure 6:
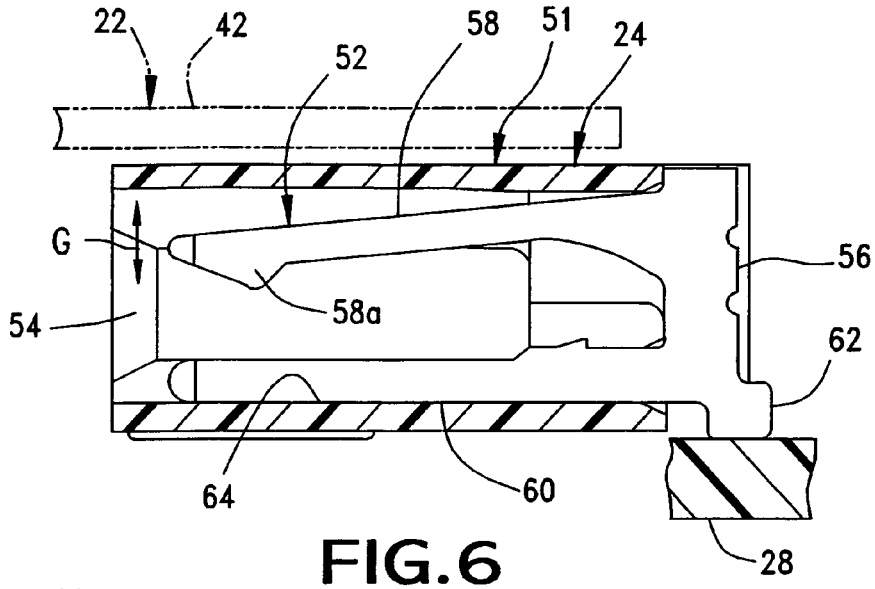
FIG. 6 is a vertical section taken generally along line C—C in FIG. 5, with a portion of the metal shell of the plug connector shown in phantom.

Referring to FIGS. 5 and 6 in conjunction with FIGS. 1 and 2, receptacle connector 24 includes an insulative or dielectric housing 51 which mounts a plurality of board terminals, generally designated 52, which are stamped from sheet metal material. The housing is adapted for mounting on top of circuit board 28 and includes a mating receptacle 54 for receiving plug portion 30*b* and signal terminals 32 of plug connector 22.

Each board terminal 52 of receptacle connector 24 is generally U-shaped and includes a base section 56 and a pair of upper and lower legs 58 and 60 which project forwardly of the base section into mating receptacle 54. A tail portion 62 of each board terminal projects outwardly of the rear of housing 51 and is connected, as by soldering, to an appropriate circuit trace on circuit board 28. Leg 60 of each board terminal 52 is a mounting leg and is fixed within a mounting groove 64 in housing 51. Upper leg 58 of each board terminal comprises a flexible contact arm which projects into mating receptacle 54. The contact arm can flex in the direction of double-headed arrow "G". An inwardly or downwardly projecting contact point 58*a* is formed near the distal end of the flexible contact arm for engaging the top surface 32*b* (FIG. 4) of a respective one of the signal terminals 32 of the plug connector.

Figure 7:
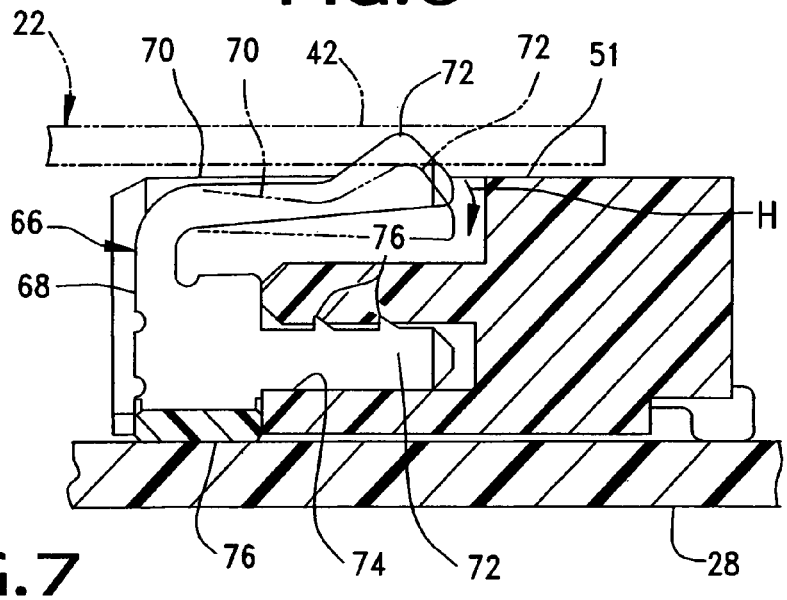
FIG. 7 is a view similar to that of FIG. 6, but taken along line D—D in FIG. 5.
Figure 9:
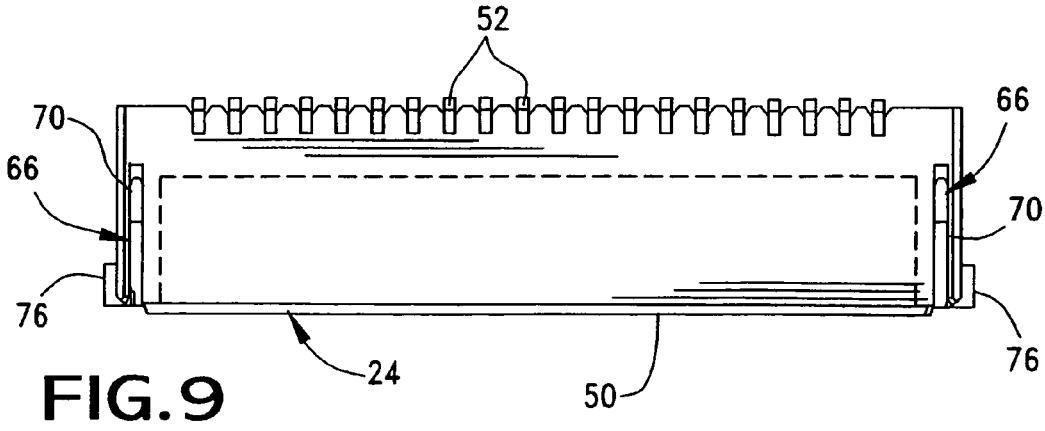
FIG. 9 is a top plan view of the receptacle connector.
Figure 8:
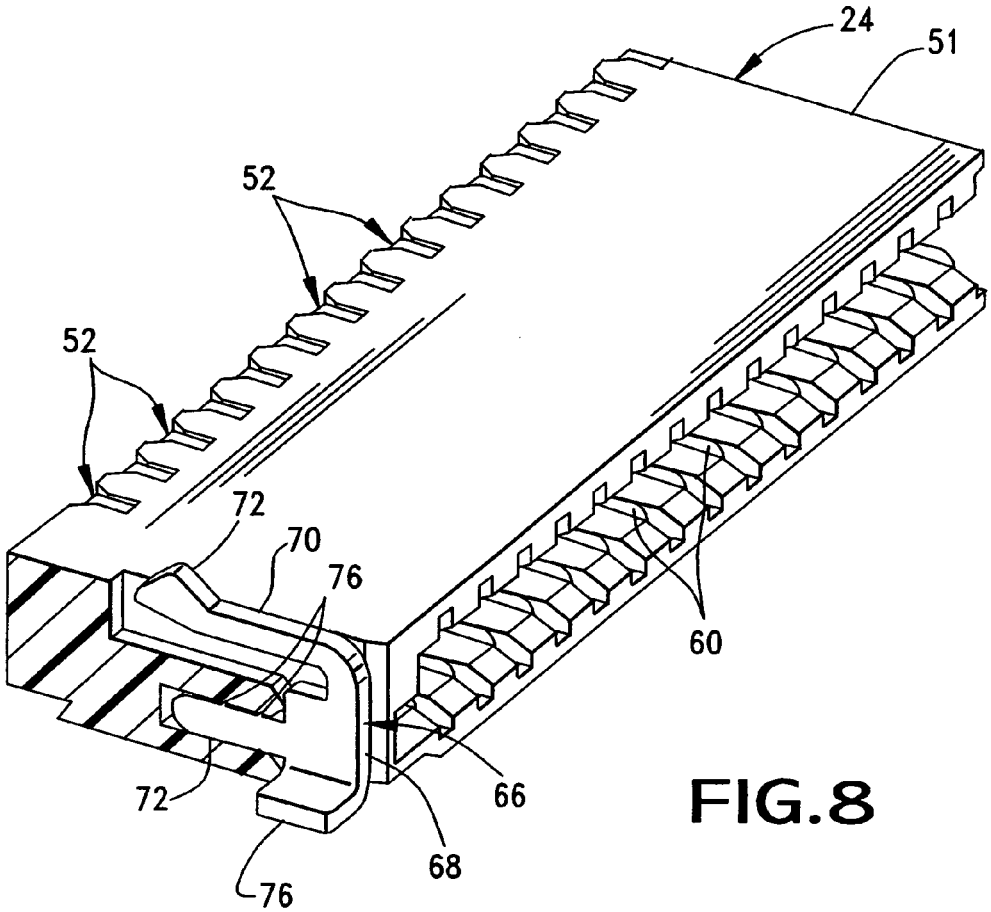
FIG. 8 is an enlarged perspective view taken generally along line E—E in FIG. 5.

FIGS. 7–9 also show that receptacle connector 24 includes a pair of ground terminals, generally designated 66, which are stamped and formed of sheet metal material. The ground terminals also are generally U-shaped and include a base section 68 and upper and lower legs 70 and 72 which project forwardly of the base section. Lower leg 72 forms a mounting leg of the ground terminal and is inserted into a mounting hole 74 in housing 51. A plurality of teeth 76 on the mounting leg bight into the dielectric housing. Upper leg 70 comprises a flexible contact arm which has an upwardly projecting contact point 72 which engages the underside of the top wall of metal shell 42. When the connectors are mated, the top wall of the metal shell engages contact point 72 and biases the contact arm downwardly in the direction of arrow □H□ from the full-line position to the phantom-line position shown in FIG. 7. Each ground terminal 66 includes a tail portion 76 as best seen in FIG. 8, for connection, as by soldering, to a ground trace on circuit board 28. Therefore, when the connectors are mated, metal shell 42 on plug connector 22 is grounded through ground terminals 66 to circuit board 28 on which receptacle connector 24 is mounted.

FIGS. 1 and 2 show plug connector (FIGS. 3 and 4) mated with receptacle connector (FIGS. 5–9). It can be seen that the single metal shell 42 which is mounted on the plug connector extends substantially over the receptacle connector and completely covers the mating interface between the respective terminals of the connectors. This provides EMI and RFI protection at the mating interface. The single metal shell eliminates a separate metal shell for the receptacle connector. The shell also covers the connecting interface with the mesh shields 26*c* of electrical cables 26. The inwardly turned flange 58 of the metal shell, along with ground bar 34, eliminates any damage which might be caused to the electrical cables, including the mesh shields, by sharp rear edges of the metal shell.

Figure 10:
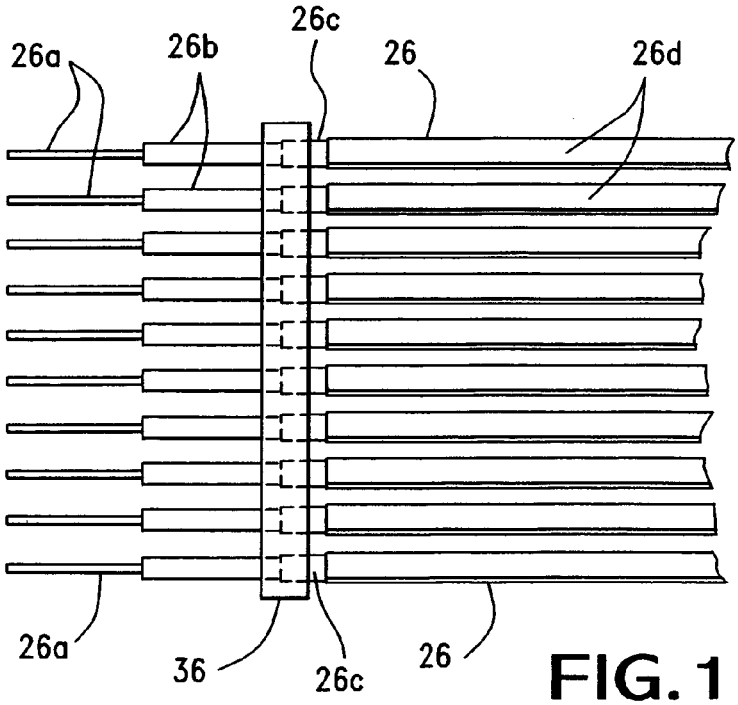
FIGS. 10–18 are sequential views showing the method of assembling the plug connector.

FIGS. 10–18 show the method of assembling plug connector 22. Specifically, electrical cables 26 are shown in FIG. 10 prepared by cutting back dielectrics 26*b* to expose distal ends of conductors 26*a*. Outer covers 26*d* also are cut-back to expose lengths of the mesh shields 26*c*. Bottom ground bar 36 (FIG. 4) then is placed on mesh shields 26*c* of all of the cables and soldered thereto.

Figure 11:
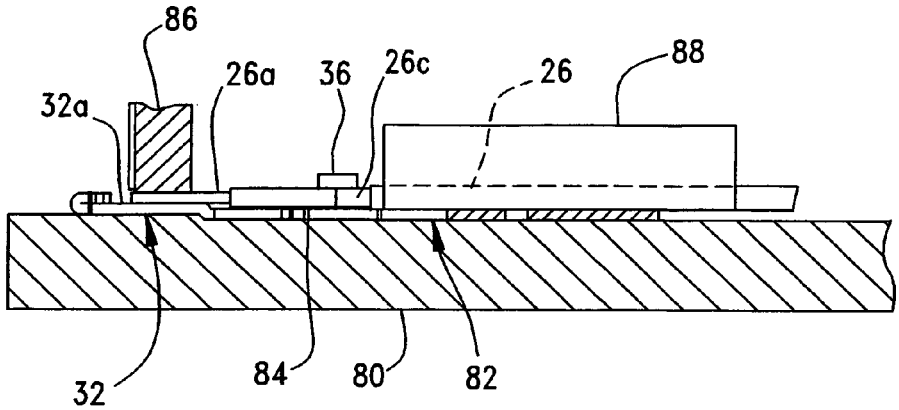

This subassembly then is placed in a base jig 80 as shown in FIG. 11. Signal terminals 32 are positioned within the jig at a proper spacing or pitch corresponding to that of conductors 26*a*. The terminals may be stamped and formed of conductive sheet metal material and still are joined by a carrier strip at a parting line 84 between the terminals and the carrier strip. Jig 80 includes a heater 86 and a press 88. The press holds the carrier strip and terminals 32 in position while heater 86 solders conductors 26*a* to bottom surfaces 32*a* of the terminals.

Figure 12:
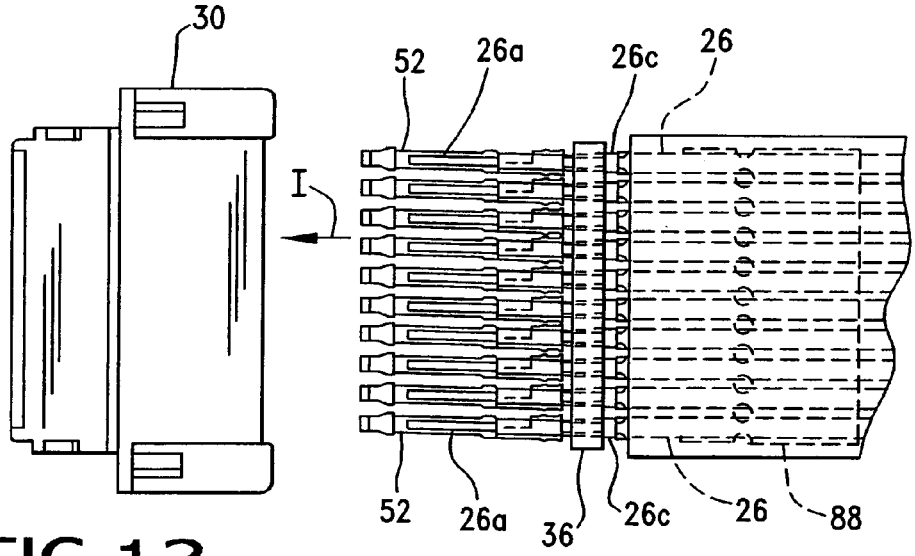
Figure 13:
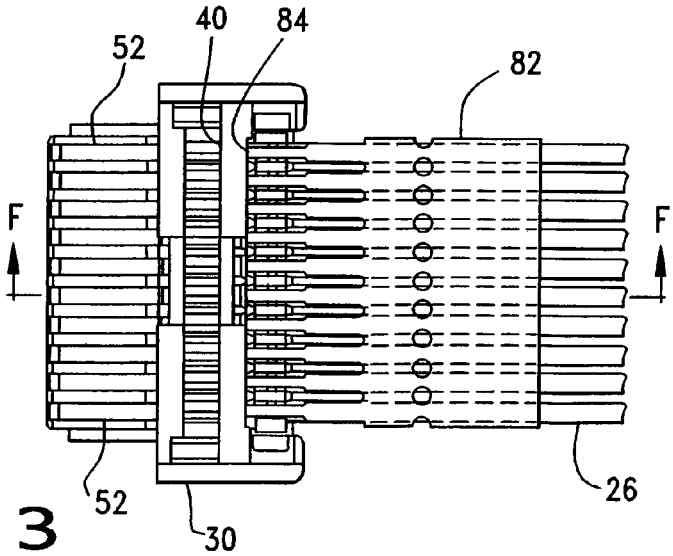
Figure 14:
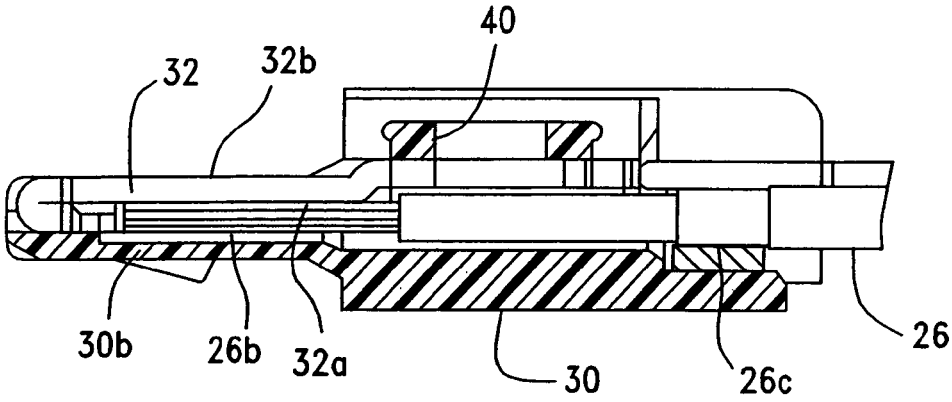

The subassembly formed by the process described above in relation to FIG. 11 then is assembled to dielectric housing 30 of the plug connector in the direction of arrow "I" as shown in FIG. 12, to a fully assembled position as shown in FIGS. 13 and 14. It can be seen that signal terminals 32, as soldered to conductors 26*a*, are positioned on top of plug portion 30*b* of the housing, with top surfaces 32*b* of the terminals facing upwardly.

Figure 15:
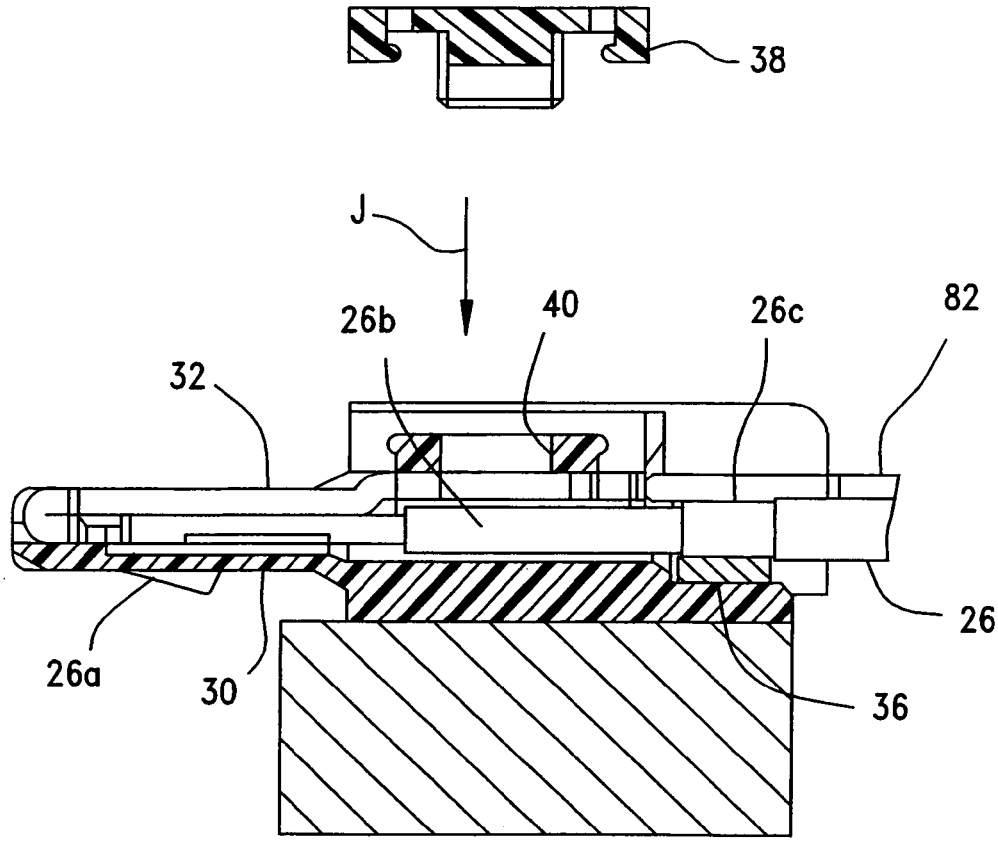

Cable retainer 38 then is forced into retainer hole 40 of the housing in the direction of arrow "J" in FIG. 15. The retainer clamps onto the top of the dielectrics 26*b* of electrical cables 26.

Figure 16:
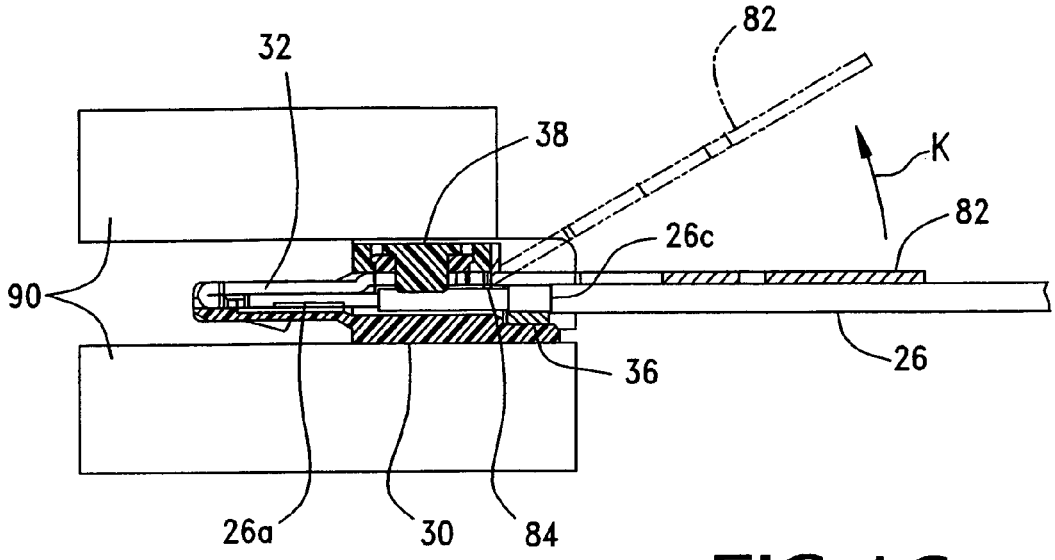
Figure 17:
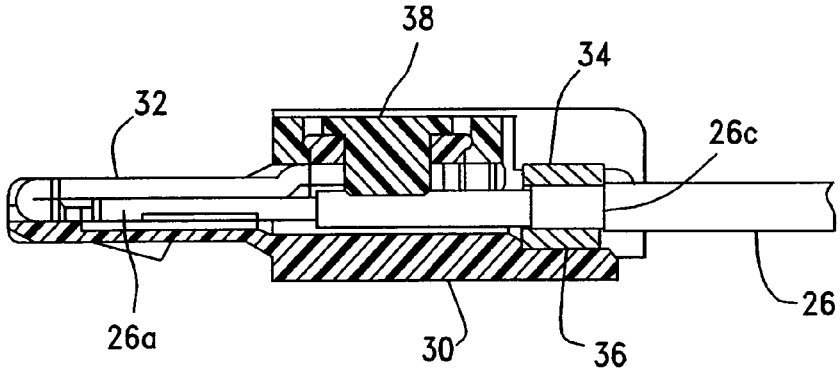

The next step is to place the subassembly (with cable retainer 38) between a clamping apparatus 90 shown in FIG. 16. Carrier strip 82 then is bent upwardly in the direction of arrow "K" to separate the strip from signal terminals 32 at parting line 84. The top ground bar 34 then is soldered to the tops of mesh shields 26*c* of electrical cables 26 as shown in FIG. 17.

Figure 18:
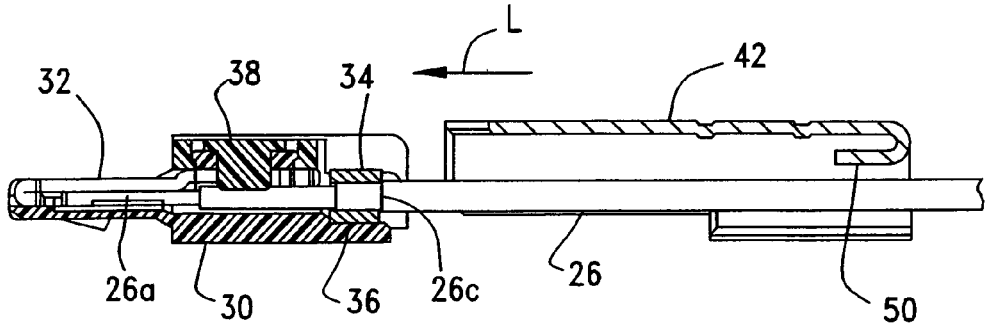

The final step in assembling plug connector 22 is to position the U-shaped metal shell 42 over cables 26 and slide the metal shell forwardly in the direction of arrow "L" in FIG. 18. The shell will move over housing 30 to the position shown in FIG. 4, and latches 49*a* (FIG. 3) will lock the shell in position, as the latches engage appropriate latch surfaces (not shown) on housing 30.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. An electrical connector assembly, comprising:

a receptacle connector (24) having a first non-conductive housing with top and side walls (51) for mounting on a printed circuit board (28) and including a mating receptacle (54), a plurality of board terminals (52) mounted on the first non-conductive housing and having tail portions (62) for connection to appropriate circuit traces on the circuit board and contact portions (58,58*a*) extending into the mating receptacle, and at least one ground terminal (66) having a tail portion (76) for connection to an appropriate ground trace on the circuit board (28) and a contact portion (72);

a plug connector (22) having a second non-conductive housing (30) including a mating plug portion (30*b*) for insertion into the mating receptacle of the receptacle connector;

a plurality of signal terminals (32) mounted on the second housing and having contact portions (32*b*) on said mating plug portion thereof for engaging the contact portions of the board terminals in the mating receptacle when the connectors are mated and terminating portions (32*a*) for termination to a plurality of discrete signal conductors (26*a*); and a single metal shell (42), with a top wall (48) and opposite side walls (49) for covering the respective top and side walls of the non-conductive housing of the receptacle connector. mounted on the second housing of the plug connector and projecting therefrom over the first housing of the receptacle connector, and further surrounding the around terminal, to shield the interface between the board terminals and the signal terminals and engageable with the contact portion (72) of the ground terminal (66) when the connectors are mated.

2. The electrical connector assembly of claim 1 wherein said signal conductors comprise conductive cores (26*a*) of a plurality of shielded electrical cables (26) having ground components (26*c*) electrically coupled to the metal shell (42).

3. The electrical connector assembly of claim 2 wherein said ground components comprise shielding sheaths (26*c*) about the signal conductors (26*a*).

4. The electrical connector assembly of claim 3, including at least one conductive ground bar (34) extending across and in engagement with the sheaths (26*c*) about the signal conductors (26*a*), an engagement portion (50) of the metal shell (42) being in engagement with the ground bar.

5. The electrical connector assembly of claim 4 wherein said engagement portion of the metal shell (42) comprising an inwardly folded flange (50) along a rear end (42*a*) of the shell (42).

6. The electrical connector assembly of claim 5 wherein said metal shell (42) includes a top wall (48), and said flange (50) is folded inwardly under a rear edge (42*a*) of the top wall and spaced therefrom.

* * * * *